US007938299B2

(12) United States Patent
Fahy et al.

(10) Patent No.: US 7,938,299 B2
(45) Date of Patent: May 10, 2011

(54) DEVICE FOR ATTACHING A DIP TUBE TO A FLUID CONTAINER

(75) Inventors: Cathal L. Fahy, Racine, WI (US); Timothy R. Bartlett, Racine, WI (US); Kenneth W. Michaels, Spring Grove, IL (US); René Maurice Béland, Waterford, WI (US); Peter M. Neumann, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 625 days.

(21) Appl. No.: 11/556,274

(22) Filed: Nov. 3, 2006

(65) Prior Publication Data

US 2008/0105763 A1 May 8, 2008

(51) Int. Cl.
*B67D 7/58* (2010.01)

(52) U.S. Cl. ..... 222/382; 222/383.1; 222/464.4

(58) Field of Classification Search ..... 222/147, 222/321.1, 321.7, 322, 372, 382, 383.1, 464.1; 239/333

See application file for complete search history.

(56) References Cited

U.S. PATENT DOCUMENTS

| | | | | |
|---|---|---|---|---|
| 1,329,524 | A | | 2/1920 | Hill |
| 2,091,737 | A | | 8/1937 | Longway |
| 2,496,258 | A | | 2/1950 | Alexander |
| 2,781,576 | A | | 2/1957 | Jennings |
| 3,655,096 | A | | 4/1972 | Easter |
| 3,672,028 | A | | 6/1972 | Boling |
| 3,674,179 | A | | 7/1972 | Galloway |
| 3,708,854 | A | | 1/1973 | Nalbach |
| 3,797,749 | A | * | 3/1974 | Tada ..... 239/321 |
| 3,880,207 | A | | 4/1975 | Giuffredi |
| 4,022,258 | A | * | 5/1977 | Steidley ..... 141/330 |
| 4,077,442 | A | * | 3/1978 | Olofsson ..... 141/20 |
| 4,154,369 | A | * | 5/1979 | Morane ..... 222/147 |
| 4,162,601 | A | | 7/1979 | Allen |
| 4,220,285 | A | | 9/1980 | Gualdi |
| 4,260,082 | A | * | 4/1981 | Rooney et al. ..... 222/340 |
| 4,591,192 | A | | 5/1986 | Van Exel et al. |
| 4,730,751 | A | | 3/1988 | Mackles et al. |
| 4,770,323 | A | | 9/1988 | Debard |
| 4,915,351 | A | | 4/1990 | Hoffman |
| 5,244,126 | A | * | 9/1993 | Geier ..... 222/383.1 |

(Continued)

FOREIGN PATENT DOCUMENTS

WO WO 2004/043611 A1 5/2004

*Primary Examiner* — Kevin P Shaver
*Assistant Examiner* — Daniel R Shearer

(57) ABSTRACT

A device for that places a fluid container in fluid communication with a sprayer is disclosed. The device includes a container adapter that allows a dip tube to be attached to the fluid container rather than the sprayer. When the sprayer is removed from the fluid container, the dip tube stays in the fluid container. Refill fluid containers may come with the container adapter and dip tube installed. When the sprayer is attached to the fluid container, the adapter seals against the sprayer allowing fluid to be pumped from the fluid container by the sprayer. A sprayer connector with geometry that matches an inner or outer shape of the adapter is attached to and/or built into the sprayer. The sprayer connector is constructed to allow easy alignment of the sprayer to the fluid container. The sprayer connector and the container adapter also provide a unique attachment geometry to insure only containers with formulae compatible to the sprayer are pumped through the sprayer.

12 Claims, 8 Drawing Sheets

U.S. PATENT DOCUMENTS 5,716,007 A 2/1998 Nottingham et al.
5,769,275 A * 6/1998 Boehmer et al. ..... 222/136
5,791,366 A 8/1998 Lo
5,803,510 A 9/1998 Dorsey, III
5,810,209 A 9/1998 Foster
5,839,620 A 11/1998 Battegazzore
5,857,591 A * 1/1999 Bachand ..... 222/1
5,862,948 A * 1/1999 Duchon et al. ..... 222/133
5,873,496 A 2/1999 Montaner et al.
5,878,915 A 3/1999 Gordon et al.
5,979,711 A * 11/1999 Fuchs et al. ..... 222/321.2
6,050,459 A 4/2000 Johnson et al.
6,138,873 A 10/2000 Gramola
6,155,462 A 12/2000 Brecheisen et al.
6,269,976 B1 8/2001 DeJonge
6,293,441 B1 * 9/2001 Tasaki et al. ..... 222/376
6,367,665 B1 4/2002 Barriac et al.
6,398,080 B1 6/2002 De LaForcade et al.
6,409,052 B1 6/2002 Barriac et al.
6,419,128 B1 7/2002 Barriac et al.
6,543,564 B1 4/2003 Kamen et al.
6,543,654 B1 4/2003 Uhl et al.
6,554,319 B2 4/2003 Barriac et al.
6,568,562 B1 5/2003 Klima, Jr. et al.
6,779,693 B2 8/2004 Sweeton et al.
6,935,542 B2 8/2005 Harrity et al.
2003/0213816 A1 11/2003 Harrity et al.
2004/0134562 A1 7/2004 Engel
2004/0262420 A1 12/2004 Hansen et al.
2005/0189380 A1 * 9/2005 Sweeton et al. ..... 222/382
2006/0174968 A1 8/2006 De Luna
2007/0138209 A1 * 6/2007 Knauer et al. ..... 222/207

* cited by examiner

DEVICE FOR ATTACHING A DIP TUBE TO A FLUID CONTAINER

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to a device including a container adapter that allows a dip tube to be attached to a fluid container rather than the fluid sprayer. When the sprayer is removed from the fluid container, the dip tube stays in the fluid container. When the sprayer is attached to the fluid container, the container adapter seals against a sprayer connector allowing fluid to be pumped from the fluid container by the sprayer.

2. Description of the Related Art

A variety of devices are known for delivering liquid from a container. Some devices rely on a manual trigger pump sprayer. See, for example, U.S. Pat. No. 4,747,523. Still other devices use a motorized pumping system such as that shown in U.S. Patent Application Publication No. 2005/0133626. The disclosure of this patent and publication, and all other patents and publications referred to herein, are incorporated by reference as if fully set forth herein.

Often these devices use a dip tube (also referred to as a down tube) that extends from the sprayer unit down into the container holding the liquid to be dispensed. The upper end of the dip tube is typically connected to a sprayer inlet port, and the lower end of the dip tube is positioned near the bottom of the interior space of the container. In such devices, the pump will suck liquid from the container through the dip tube and then pump the liquid out of a sprayer nozzle.

It can be important to prevent the use of a liquid not intended for use with a particular sprayer. For example, one may not want to mistakenly use an outdoor insecticide in a sprayer intended to dispense a cleaner for an indoor food contact surface. Therefore, under these circumstances, it is preferred that the sprayer and/or refill container include keying structures that prevent use of a refill containing an inappropriate liquid with the sprayer. These keying structures ensure that only refill containers containing a liquid appropriate for a particular purpose are used with the sprayer. These keying structures may also provide for easy alignment of the sprayer and the fluid container, both during high speed automated assembly of the sprayer to a container at a manufacturing site and when a consumer assembles a refill container to a sprayer.

Thus, there is a need for a device that places a fluid container in fluid communication with a sprayer and that provides a keying structure such that only refill containers having a liquid appropriate for a particular purpose are used with the sprayer.

SUMMARY OF THE INVENTION

The foregoing needs can be met with a device according to the invention which includes a container adapter that allows the dip tube to be attached to the fluid container rather than the sprayer. When the sprayer is removed from the fluid container, the dip tube stays in the fluid container. Refill fluid containers may come with the adapter and dip tube installed. When the sprayer is attached to the fluid container, the adapter seals against a sprayer connector allowing fluid to be pumped from the fluid container by the sprayer.

In one form, a feature with geometry that matches the inner or outer shape of the container adapter is attached to and/or built into the sprayer. The feature is constructed to allow easy alignment of the sprayer to the fluid container. The container adapter also provides a unique attachment geometry to insure only containers with formulae compatible to the sprayer are pumped through the sprayer. Thus, the invention may include two parts, the first is being the container adapter which is fit into or onto the neck of a fluid container. The container adapter includes structure for attaching the dip tube to the adapter. The second part of the invention may be a mating sprayer connector which is attached to the sprayer inlet port such as by a friction fit. Alternatively, the sprayer connector can be integral with the sprayer to incorporate the necessary geometry. When the sprayer is placed onto the fluid container, the mating sprayer connector is pressed into or over the container adapter thereby sealing the mating sprayer connector against a surface of the container adapter.

In one aspect, the invention provides a device for placing an inlet port of a sprayer in fluid communication with an interior space of a container. The device includes a container adapter with (i) an outer wall that terminates at an open end of the adapter wherein the outer wall is dimensioned to engage an inner surface of the neck of the container, (ii) a hollow inlet port that terminates at an upstream open end and that terminates at a downstream open end, and (iii) a hollow inner wall connecting the outer wall and the upstream open end of the inlet port wherein at least part of the inner wall slopes inward from the outer wall toward the upstream open end of the inlet port. Together the inner wall and the inlet port of the adapter may be funnel shaped. The device also includes a sprayer connector having a flow conduit suitable for being placed in fluid communication with the inlet port of the sprayer and the adapter wherein the sprayer connector is dimensioned to matingly engage the inner wall of the adapter to create a flow path from the container to the sprayer. The sprayer connector may be integral with the inlet port of the sprayer.

The device may further include a dip tube, and the downstream open end of the inlet port of the adapter may be dimensioned to sealingly engage the dip tube. The inner wall of the adapter may include venting holes for transferring air into the container. The outer surface of the sprayer connector or inner surface of the adapter may include at least one sealing rib for an air-tight fit. Optionally, the open end of the adapter includes an outwardly projecting lateral flange for engaging a top surface of the neck of the container or a gasket on the top surface of the neck of the container. The adapter may further include a skirt that extends longitudinally from the lateral flange, and an inner surface of the skirt may include a sealing protrusion for engaging an outer surface of the neck of the container. The outer surface of the skirt may also include threads for engaging inner threads on a sprayer attachment cap. The sprayer connector may include an outwardly extending exit port in fluid communication with the flow conduit, and the exit port may be dimensioned to sealingly engage the inlet port of the sprayer.

In another aspect, the invention provides a fluid container for attaching to a sprayer having an inlet port. The container may be sold as a separate refill container with a dip tube and without the sprayer. The container includes a bottom wall, side wall structure, and a neck having an opening. The bottom wall, the side wall structure, and the neck define an interior space of the container for holding liquid. The container also includes a container adapter having (i) an outer wall that terminates at an open end of the adapter wherein the outer wall is dimensioned to engage an inner surface of the neck of the container, (ii) a hollow inlet port that terminates at an upstream open end and that terminates at a downstream open end, and (iii) a hollow inner wall connecting the outer wall and the upstream open end of the inlet port wherein at least part of the inner wall slopes inward from the outer wall toward the upstream open end of the inlet port.

The refill container may have other features. The inlet port of the adapter may further comprise a dip tube that is separable from the inlet port of the adapter, and the downstream open end of the inlet port of the adapter may be dimensioned to sealingly engage the dip tube. The inner wall of the adapter may include venting holes for transferring air into the container. The open end of the adapter may include an outwardly projecting lateral flange for engaging a top surface of the neck of the container or a gasket on the top surface of the neck of the container. The adapter may further include a skirt that extends longitudinally from the lateral flange, and an inner surface of the skirt may include a sealing protrusion for engaging a groove in an outer surface of the neck of the container. The outer surface of the skirt may also include threads for engaging threads on a sprayer attachment cap.

In yet another aspect, the invention provides a device for placing an inlet port of a sprayer in fluid communication with an interior space of a container. The device has a container adapter including (i) a hollow inlet port that terminates at an downstream open end and that terminates at an upstream end, and (ii) an outer wall that terminates at an open end of the adapter opposite the upstream end of the inlet port of the adapter wherein the outer wall is connected to the inlet port and an inner surface of the outer wall is dimensioned to engage an outer surface of the neck of the container. The device also includes a sprayer connector having a flow conduit suitable for being placed in fluid communication with the inlet port of the sprayer wherein an inner surface of the sprayer connector is dimensioned to matingly engage an outer surface of the outer wall of the adapter to create a flow path from the container to the sprayer. The inlet port of the adapter may further comprise a dip tube that is separable from the inlet port of the adapter, and the downstream open end of the inlet port of the adapter may be dimensioned to sealingly engage the dip tube. The outer surface of the outer wall of the adapter may include a sealing protrusion, and the inner surface of the sprayer connector may include a recess for matingly engaging the sealing protrusion. The upstream end of the inlet port may be a projection having flow holes. Optionally, the sprayer connector is integral with the inlet port of the sprayer.

In still another aspect, the invention provides a fluid container for attaching to a sprayer having an inlet port. The container may be sold as a separate refill container with a dip tube and without the sprayer. The container includes a bottom wall, side wall structure, and a neck having an opening. The bottom wall, the side wall structure, and the neck define an interior space of the container for holding liquid. The container also includes a container adapter having (i) a hollow inlet port that terminates at an downstream open end and that terminates at an upstream end, and (ii) an outer wall that terminates at an open end of the adapter opposite the upstream end of the inlet port of the adapter wherein the outer wall is connected to the inlet port, and an inner surface of the outer wall sealingly engages an outer surface of the neck of the container. The inlet port of the adapter may further comprise a dip tube that is separable from the inlet port of the adapter, and the downstream open end of the inlet port of the adapter may be dimensioned to sealingly engage the dip tube. The outer surface of the outer wall of the adapter may include a sealing protrusion, and the inner surface of the sprayer connector may include a recess for matingly engaging the sealing protrusion. The upstream end of the inlet port may be a projection having flow holes. Optionally, the sprayer connector is integral with the inlet port of the sprayer.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
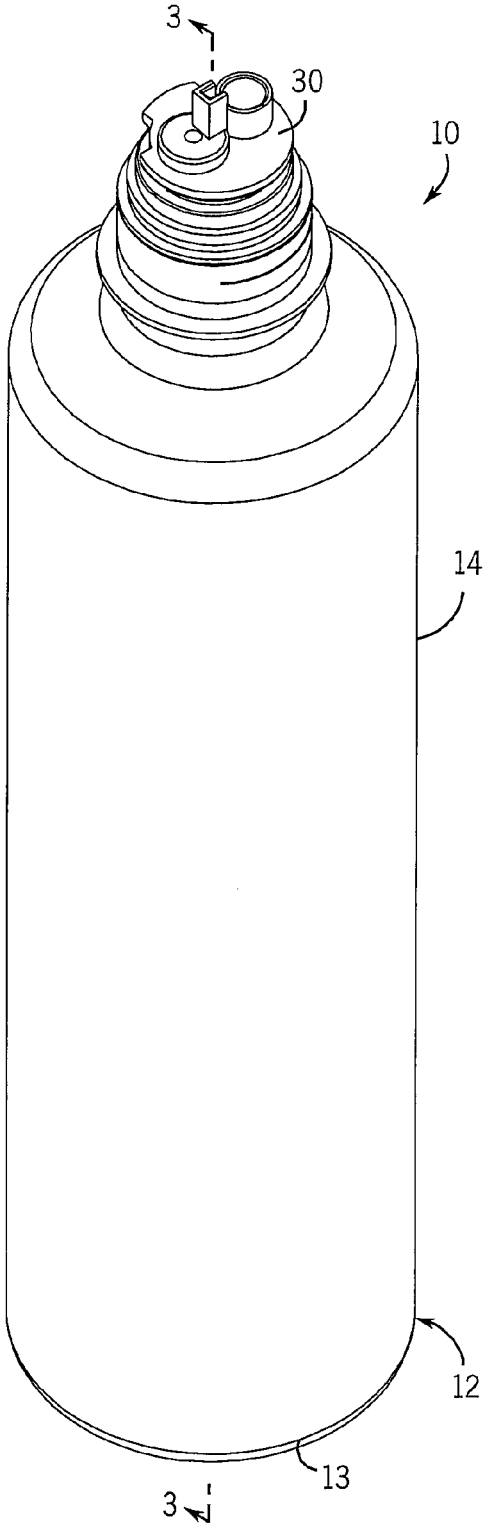
FIG. 1 is a perspective view of a device according to a first embodiment of the invention with a trigger sprayer head removed.
Figure 2:
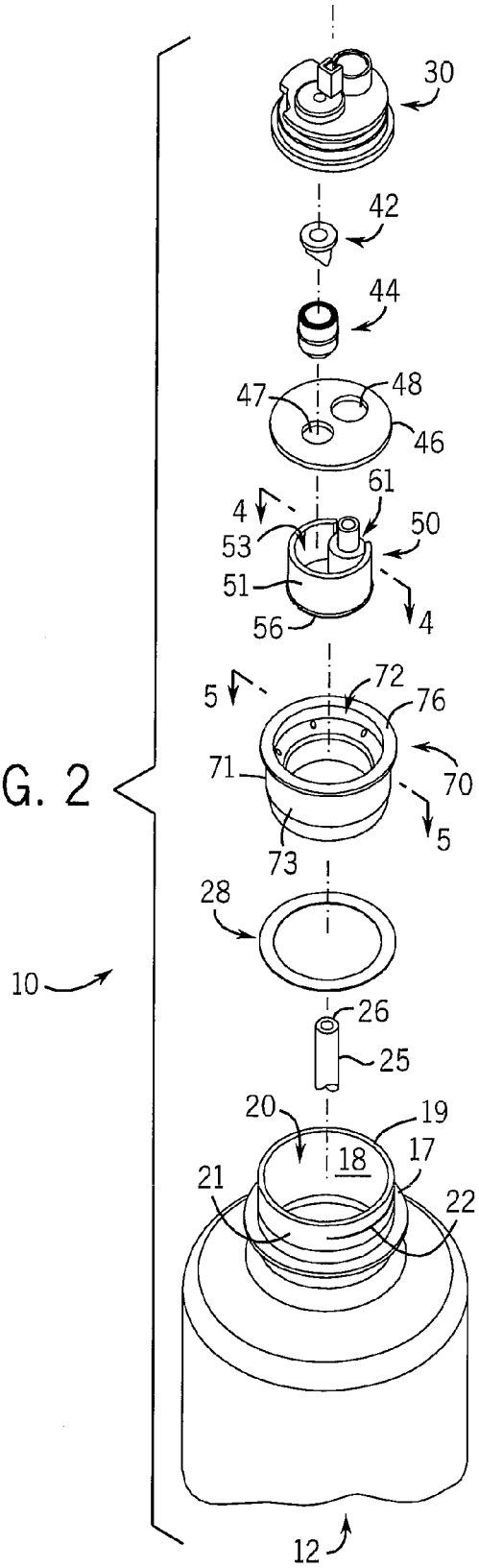
FIG. 2 is an exploded perspective view of the device of FIG. 1.

Turning first to FIGS. 1 to 5, there is shown an embodiment of a device 10 according to the invention. The device 10 may be used with a container 12 having a bottom wall 13 that is integral with a side wall 14. The bottom wall 13 and the side wall 14 define an interior space 15 of the container 12. The side wall 14 of the container 12 terminates at its upper end in a neck 17 having an inner surface 18 and a top surface 19 that define a container opening 20. The outer surface 21 of the container 12 has threads 22 for engaging a sprayer attachment cap as described below. A dip tube 25 with a downstream end 26 is provided for suctioning fluid from the interior space 15 of the container 12. An annular flat container gasket 28 is provided for sealing the top surface 19 of the neck 17 as described below. The container 12, the dip tube 25 and the container gasket 28 may be formed from plastic materials.

Figure 3:
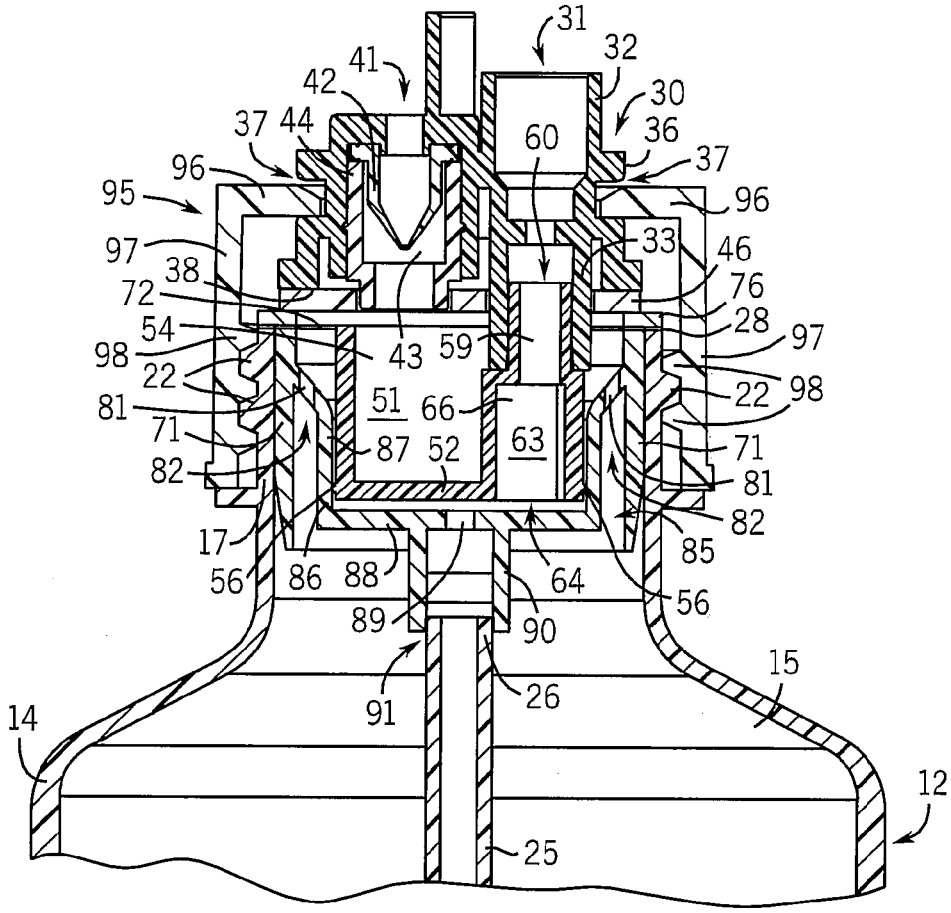
FIG. 3 is a cross-sectional view taken along line 3-3 of FIG. 1.
Figure 4:
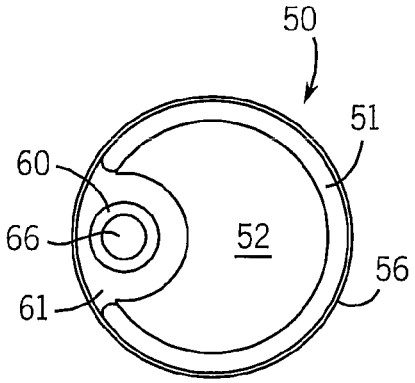
FIG. 4 is a top view of a sprayer connector of the device of the first embodiment of the invention taken along line 4-4 of FIG. 2.

The device 10 is suitable for use with a sprayer. In FIGS. 1 to 5, there is shown a generally circular sprayer base 30 for a sprayer such as that described in U.S. Patent Application Publication No. 2005/0133626. The specific sprayer selected for use with the invention is not critical and therefore, some sprayer parts other than the sprayer base 30 have been omitted for ease of illustration. The sprayer base 30 has an inlet port 31 including a downstream tubular end 32 and an upstream tubular end 33. The inlet port 31 provides an inlet fluid path that provides fluid to the pump of the sprayer such that the pump can spray the fluid out of the sprayer nozzle as is well known in the art. The sprayer base 30 also includes an outer wall 36 with an annular recess 37 for mounting a sprayer cap as described below, and a lower surface 38. The sprayer base 30 also has a venting valve assembly 41 that provides a vent path such that air may pass downward through the sprayer base 30. The venting valve assembly 41 is constructed by placing a duckbill valve 42 in vent passageway 43 of the sprayer base 30. A valve cover 44 secures the duckbill valve 42 in the vent passageway 43 as shown in FIG. 3. A disc-like sprayer gasket 46 is also included for sealing the lower surface 38 of the sprayer base 30. The sprayer gasket 46 has a vent hole 47 for surrounding the valve cover 44 and a sprayer port hole 48 for surrounding the inlet port 31 of the sprayer base 30. The sprayer base 30, duckbill valve 42, valve cover 44 and sprayer gasket 46 may be formed from plastic materials.

Referring still to FIGS. 1 to 5, the device 10 according to the invention includes a sprayer connector 50 that connects to the upstream tubular end 33 of the inlet port 31 of the sprayer base 30. The sprayer connector 50 has a tubular outer wall 51 that terminates at one end in a bottom wall 52 and that terminates at an opposite end in an open top end 53. The outer wall 51 and the bottom wall 52 define an interior 54 of the sprayer connector 50. The outer wall 51 of the sprayer connector 50 has an outwardly projecting circumferential rib 56 near the bottom wall 52 of the sprayer connector 50. The sprayer connector 50 includes an upper inner tubular section 59 that terminates in a fluid exit port 60 of the sprayer connector 50. The outer wall 51 of the sprayer connector 50 has an outer wall cutaway section 61 that provides a fluid path out of the interior 54 of the sprayer connector 50 around the outside of the upper inner tubular section 59. The sprayer connector 50 includes a lower inner tubular section 63 that terminates in a fluid entry port 64 of the sprayer connector 50. The upper inner tubular section 59, the fluid exit port 60, the lower inner tubular section 63 and the fluid entry port 64 define an end to end flow conduit 66 in the sprayer connector 50. The sprayer connector 50 may be formed from a plastic material such as acrylonitrile butadiene styrene (ABS) or like material.

Still looking at FIGS. 1 to 5, the device 10 according to the invention includes a container adapter 70 that connects to the neck 17 of the container 12. The container adapter 70 has a cylindrical outer wall 71 that terminates in a downstream open end 72. The outer wall 71 of the container adapter 70 has an outer surface 73 that engages the inner surface 18 of the neck 17 of the container 12 when the container adapter 70 is assembled to the container 12 as shown in FIG. 3. An annular flange 76 extends outwardly from the outer wall 71 of the container adapter 70 at the downstream open end 72 of the container adapter 70. The flange 76 engages the flat container gasket 28 on the top surface 19 of the neck 17 of the container 12 when the container adapter 70 is assembled to the container 12 as shown in FIG. 3. The container adapter 70 also includes a sloping inner wall 81 that is connected to the outer wall 71 and that defines an annular space 82 between the inner wall 81 and the outer wall 71. Venting holes 83 are provided in the inner wall 81. The venting holes 83 provide an air path between the downstream open end 72 of the container adapter 70 and the annular space 82 between the inner wall 81 and the outer wall 71. The container adapter 70 also includes an inlet port 85 that is connected to the inner wall 81. The inlet port 85 has an upper tubular section 86 that terminates in an upstream open end 87 and that terminates at an opposite end at a bottom wall 88. A central hole 89 is provided in the bottom wall 88 and leads to a lower tubular section 90 of the inlet port 85. The lower tubular section 90 terminates in a downstream open end 91 of the inlet port 85 which receives the dip tube 25 in a friction fit. The container adapter 70 can be made of a plastic material such as polyethylene or polypropylene.

Figure 3A:
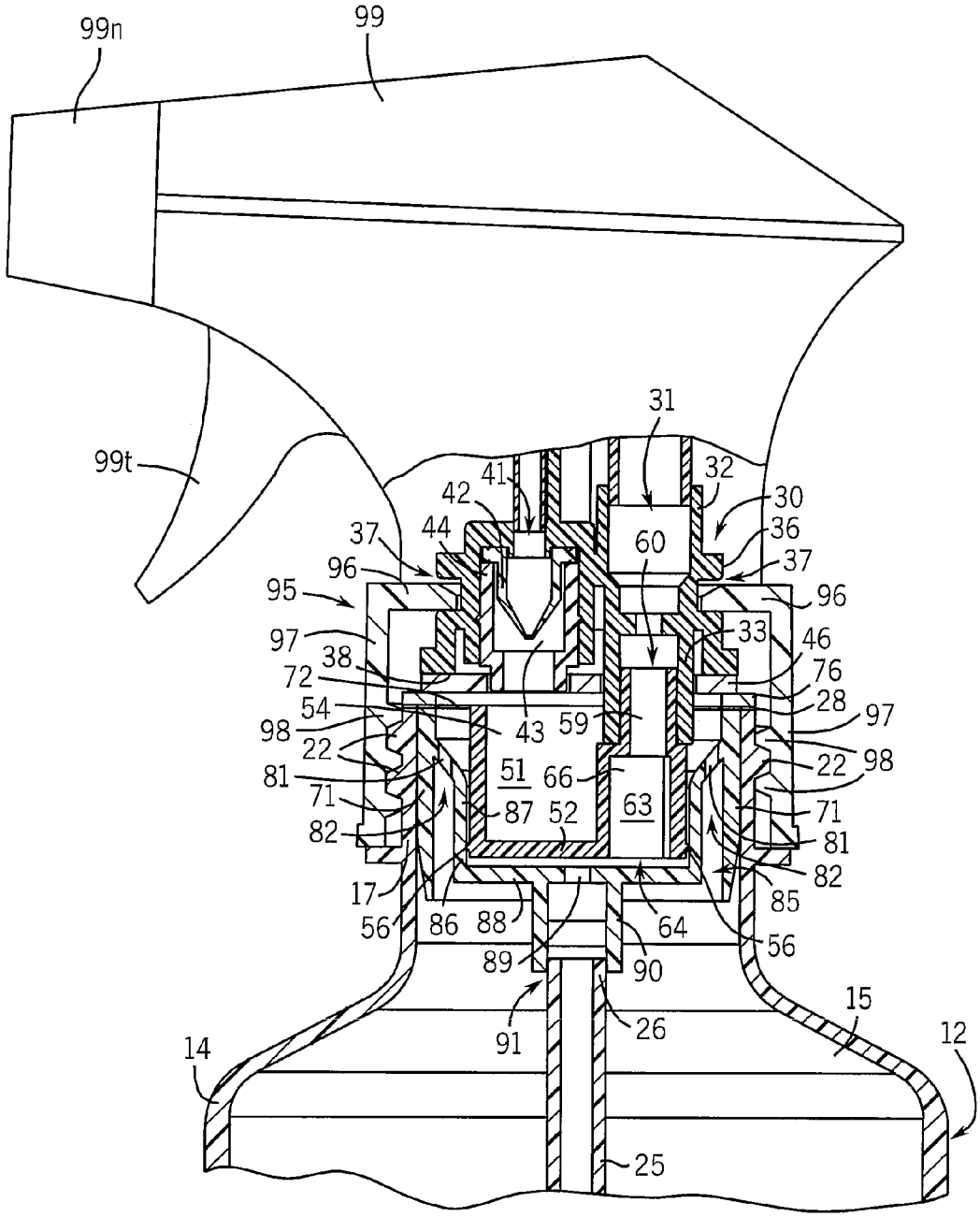
FIG. 3A is a cross-sectional view similar to FIG. 3 with a sprayer head shown on the device.
Figure 6:
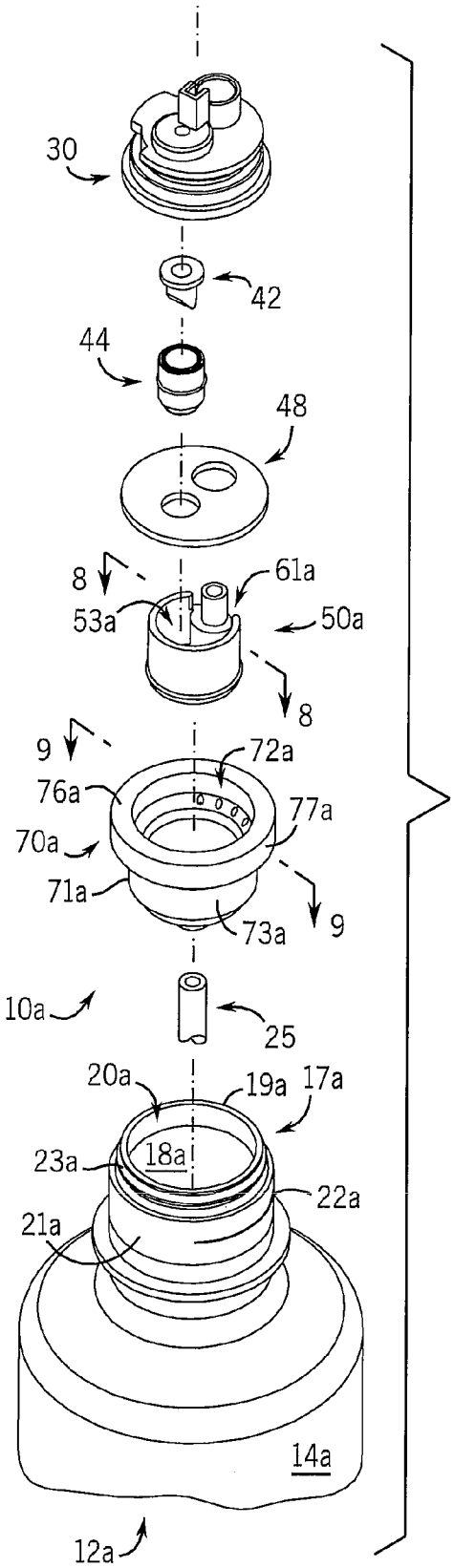
FIG. 6 is an exploded perspective view of a device according to a second embodiment of the invention.
Figure 8:
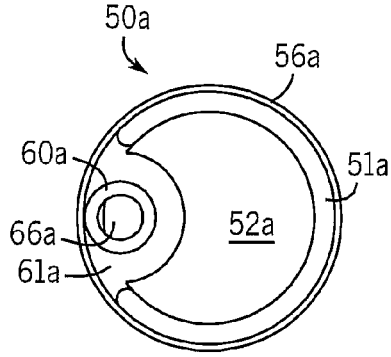
FIG. 8 is a top view of a sprayer connector of the device of the second embodiment of the invention taken along line 8-8 of FIG. 6.
Figure 9:
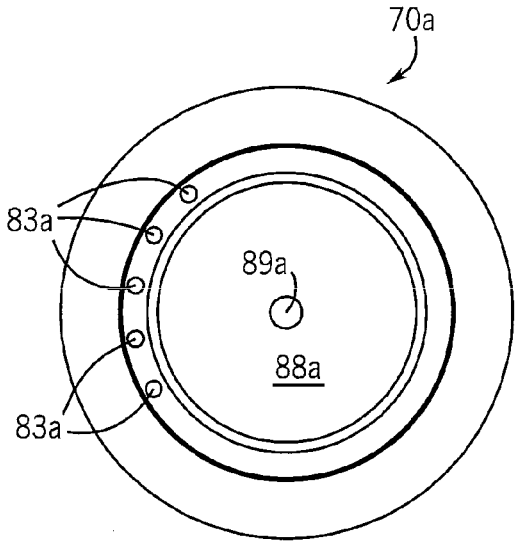
FIG. 9 is a top view of a container adapter of the device of the second embodiment of the invention taken along line 9-9 of FIG. 6.

A sprayer attachment cap 95 is provided for securing the sprayer base 30 of the sprayer to the neck 17 of the container 12 as shown in FIG. 3. The cap 95 has an annular top wall 96 and a cylindrical skirt 97 that depends downward from the top wall 96. The inner surface of the skirt 97 has threads 98 that engage the threads 22 on the outer surface 21 of the container 12 when the sprayer is assembled to the container 12. The inner edge of the annular top wall 96 of the cap 95 is secured for rotating movement in the annular recess 37 of the outer wall 36 of the sprayer base 30. FIG. 3A shows a sprayer 99 with the sprayer attachment cap 95. The sprayer 99 has the usual nozzle 99*n* and trigger 99*t*. Pumping means for delivering fluid from the inlet port 31 of the sprayer 99 to the nozzle 99*n* of the sprayer 99 by way of actuation of the trigger 99*t* are known in the art and therefore will not be explained further.

Assembly of a sprayer to the container 12 proceeds as follows. A sprayer is selected with a sprayer base such as the sprayer base 30 and a cap such as cap 95 mounted on the sprayer base 30. The venting valve assembly 41 is constructed by placing a duckbill valve 42 in vent passageway 43 of the sprayer base 30 and then securing the valve cover 44 over the duckbill valve 42 in the vent passageway 43 as shown in FIG. 3. The disc-like sprayer gasket 46 is then placed on the lower surface 38 of the sprayer base 30. The exit port 60 of the sprayer connector 50 is then inserted into the downstream tubular end 32 of the sprayer base 30 as shown in FIG. 3. The sprayer connector 50 and the sprayer base 30 may be separate parts as shown in FIGS. 1 to 5 or alternatively, the sprayer connector 50 and the sprayer base 30 may be integrally formed as a single piece. In this manner, a sprayer with the sprayer connector 50 is provided for connection to the container 12.

The container adapter 70 is assembled to the container 12. The dip tube 25 is inserted into the downstream open end 91 of the inlet port 85 of the container adapter 70 in a friction fit. Alternatively, the container adapter 70 and the dip tube 25 may be integrally formed as a single piece, or may be secured together such as by adhesive or friction welding. The container adapter 70 and the dip tube 25 are then inserted into the opening 20 of the container 12 so that the outer surface 73 of the outer wall 71 of the container adapter 70 engages the inner surface 18 of the neck 17 of the container 12 as shown in FIG. 3. The annular flange 76 engages the flat container gasket 28 on the top surface 19 of the neck 17 of the container 12 as shown in FIG. 3. In this manner, a container 12 with a container adapter 70 and attached dip tube 25 is provided for connection to a sprayer with the sprayer connector 50.

In an example automated assembly of the sprayer with the sprayer connector 50 to the container 12 with the container adapter 70 and attached dip tube 25, a plurality of the containers 12 with the container adapter 70 and attached dip tube 25 travel on a conveyor. A sprayer 99 with the sprayer connector 50 is then lowered over each container 12 with the container adapter 70 and attached dip tube 25. The outer wall 51 of the sprayer connector 50 is aligned with the upper tubular section 86 of the inlet port 85 of the container adapter 70. The sprayer connector 50 is then lowered into the container adapter 70 such that the rib 56 on the outer wall 51 of the sprayer connector 50 seals with the inner surface of the upper tubular section 86 of the inlet port 85 of the container adapter 70. The cap 95 is then automatically threaded on the threads 22 on the outer surface 21 of the container 12 to secure the sprayer 99 to the container 12. While the invention has been illustrated herein with a threaded cap 95, alternative means are suitable for attaching the sprayer to the container. For example, bayonet-type couplings have been used to couple a sprayer and a container. U.S. Pat. No. 6,138,873 shows an example bayonet-type coupling.

The container adapter 70 is dimensioned to provide for easier automated assembly. For example, the sloping inner wall 81 of the container adapter 70 guides the outer wall 51 of the sprayer connector 50 into the upper tubular section 86 of the inlet port 85 of the container adapter 70. Also, the inside diameter of the upper tubular section 86 of the inlet port 85 of the container adapter 70 may decrease from top to bottom to further guide the outer wall 51 of the sprayer connector 50 into the bottom region of the upper tubular section 86 of the inlet port 85 of the container adapter 70 wherein the rib 56 engages the inner surface of the upper tubular section 86 of the inlet port 85 of the container adapter 70.

Figure 5:
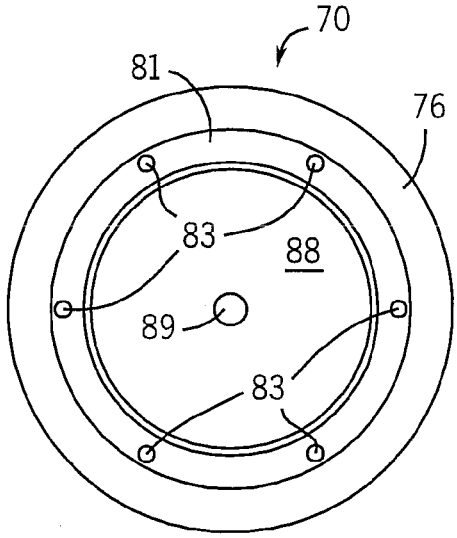
FIG. 5 is a top view of a container adapter of the device of the first embodiment of the invention taken along line 5-5 of FIG. 2.

Referring to FIG. 5, fluid flow in the device 10 is as follows during use of the assembled device. When the sprayer 99 is actuated (for example, by repeatedly pulling a manual trigger that operates a pump or by pulling a trigger switch that activates an electric pump), liquid in the interior space 15 of the container 12 is suctioned up through dip tube 25. The liquid then enters the lower tubular section 90 of the inlet port 85, passes through the central hole 89, and enters the bottom of the upper tubular section 86 of the inlet port 85. The liquid then enters the fluid entry port 64 of the sprayer connector 50 and flows into the lower inner tubular section 63 of the sprayer connector 50. Because the rib 56 seals against the inner surface of the upper tubular section 86 of the inlet port 85 of the container adapter 70, liquid is prevented from flowing above the rib 56 between the inner surface of the upper tubular section 86 of the inlet port 85 of the container adapter 70 and the outer wall 51 of the sprayer connector 50. From the lower inner tubular section 63 of the sprayer connector 50, the liquid flows into the upper inner tubular section 59 of the sprayer connector 50 and exits the fluid exit port 60. The liquid flows into the upstream tubular end 33 of the inlet port 31 of the sprayer base 30 and then into downstream tubular end 32 of the sprayer base 30. The liquid then enters the pumping system (not shown) of the sprayer 99 for spraying out of the nozzle 99*n* of the sprayer 99.

As the sprayer 99 is actuated and liquid is removed from the interior space 15 of the container 12, negative pressure may result in the container 12. The pressure differential is eliminated by way of the venting valve assembly 41 and the venting holes 83 in the container adapter 70. Because of the negative pressure, the duckbill valve 42 opens and air passes downward through the duckbill valve 42 into the vent passageway 43 of the sprayer base 30. The air then travels into the downstream open end 72 of the container adapter 70 and then into the annular space 82 between the inner wall 81 and the outer wall 71 of the container adapter 70 by way of the venting holes 83. The air then enters the interior space 15 of the container 12 equalizing the pressure inside and outside the container 12.

Because the rib 56 seals against the inner surface of the upper tubular section 86 of the inlet port 85 of the container adapter 70, air is prevented from flowing below the rib 56 between the inner surface of the upper tubular section 86 of the inlet port 85 of the container adapter 70 and the outer wall 51 of the sprayer connector 50. Thus, the rib 56 serves to establish and maintain independent liquid and air flow paths when the container adapter 70 and the sprayer connector 50 are assembled together. Alternatively, an inner surface of the adapter 70 may include a sealing rib for engaging the outer surface of the sprayer connector 50. Also, the rib may take the form of an O-ring.

The mating dimensions of the sprayer connector 50 and the container adapter 70 also provide keying structures that ensure that only refills containing a liquid appropriate for a particular purpose are used with the sprayer. Specifically, a tight fit is required between the sprayer connector 50 and the container adapter 70 so that the sprayer may be primed with liquid by way of the dip tube 25. If air leakage were to occur between the inner surface of the upper tubular section 86 of the inlet port 85 of the container adapter 70 and the outer wall 51 of the sprayer connector 50, the sprayer would suck air into the sprayer rather than liquid. Therefore, only refills comprising a container 12 with an attached container adapter 70 that mates with the sprayer connector 50 of the sprayer 99 would be suitable for use with the container.

Turning now to FIGS. 6 to 9, there is shown a second embodiment of a device 10*a* according to the invention. The device 10*a* may be used with a container 12*a* having a bottom wall that is integral with a side wall as in container 12 of FIG. 1. The bottom wall and the side wall 14*a* define an interior space 15*a* of the container 12*a*. The side wall 14*a* of the container 12*a* terminates at its upper end in a neck 17*a* having an inner surface 18*a* and a top surface 19*a* that define a container opening 20*a*. The outer surface 21*a* of the neck 17*a* of the container 12*a* has threads 22*a* for engaging a sprayer cap as described below. The outer surface 21*a* of the neck 17*a* of the container 12*a* also has an annular groove 23*a* for engaging a container adapter 70*a* as described below. A dip tube 25 as in FIGS. 1-5 is provided for suctioning fluid from the interior space 15*a* of the container 12*a*. The container 12*a* may be formed from plastic materials.

The device 10*a* is suitable for use with a sprayer. In FIGS. 6 to 9, there is shown a generally circular sprayer base 30 for a sprayer such as that described above with reference to FIGS. 1 to 5. Therefore, a description of the sprayer base 30 in FIGS. 6-9 is the same as that provided above for FIGS. 1-5.

Referring still to FIGS. 6 to 9, the device 10*a* according to the invention includes a sprayer connector 50*a* that connects to the upstream tubular end 33 of the inlet port 31 of the sprayer base 30 as in the embodiment of FIGS. 1-5. The sprayer connector 50*a* has a tubular outer wall 51*a* that terminates at one end in a bottom wall 52*a* and that terminates at an opposite end in an open top end 53*a*. The outer wall 51*a* and the bottom wall 52*a* define an interior 54*a* of the sprayer connector 50*a*. The outer wall 51*a* of the sprayer connector 50*a* has an outwardly projecting rib 56*a* near the bottom wall 52*a* of the sprayer connector 50*a*. The sprayer connector 50*a* includes an upper inner tubular section 59*a* that terminates in a fluid exit port 60*a* of the sprayer connector 50*a*. The outer wall 51*a* of the sprayer connector 50*a* has an outer wall cutaway section 61*a* that provides a fluid path out of the interior 54*a* of the sprayer connector 50*a*. The sprayer connector 50*a* includes a lower inner tubular section 63*a* that terminates in a fluid entry port 64*a* of the sprayer connector 50*a*. The upper inner tubular section 59*a*, the fluid exit port 60*a*, the lower inner tubular section 63*a* and the fluid entry port 64*a* define a flow conduit 66*a* in the sprayer connector 50*a*. The sprayer connector 50*a* may be formed from a plastic material such as ABS or like material.

Figure 7:
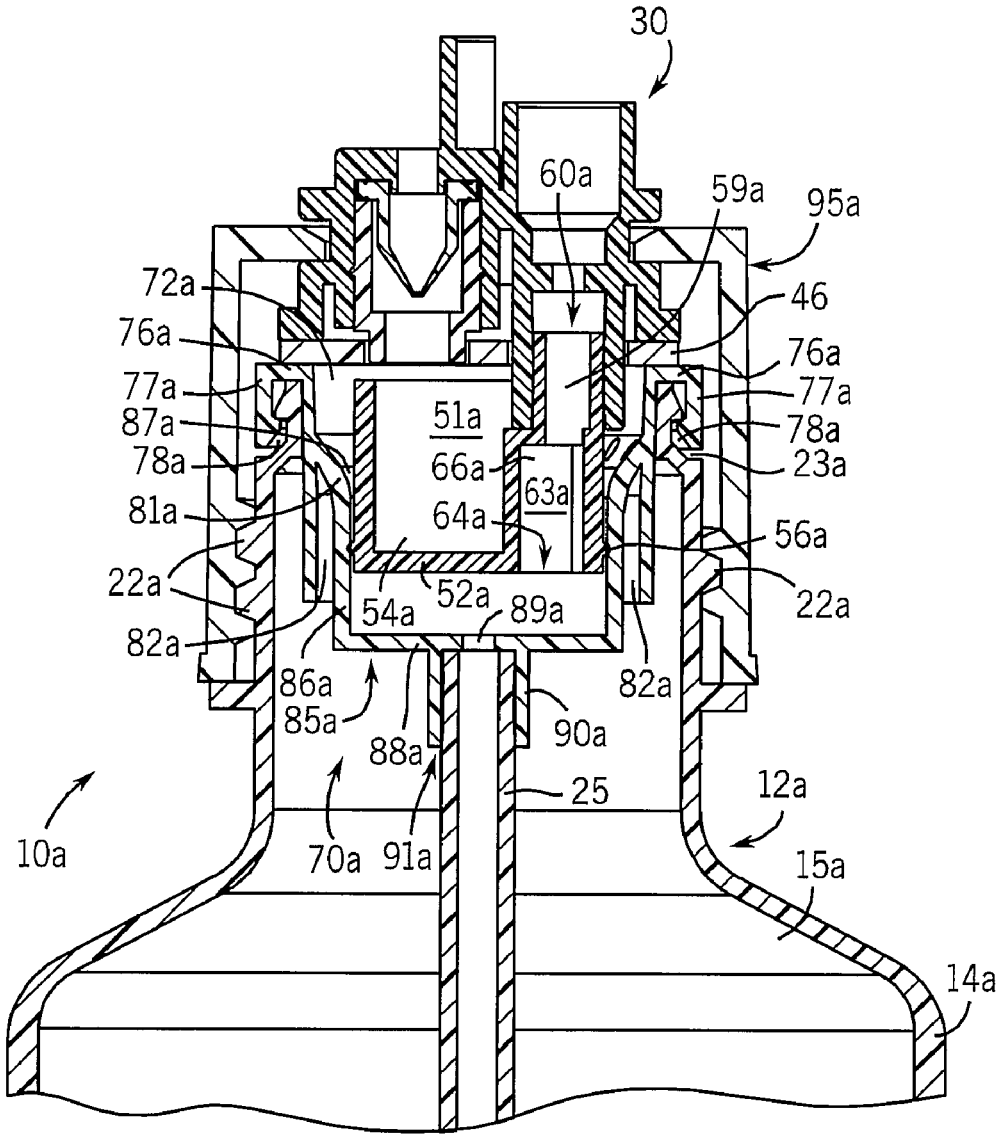
FIG. 7 is a cross-sectional view similar to that of FIG. 3 of the device of FIG. 6.

Still looking at FIGS. 6 to 9, the device 10*a* according to the invention includes a container adapter 70*a* that connects to the neck 17*a* of the container 12*a*. The container adapter 70*a* has a cylindrical outer wall 71*a* that terminates in a downstream open end 72*a*. The outer wall 71*a* of the container adapter 70 has an outer surface 73*a* that engages the inner surface 18*a* of the neck 17*a* of the container 12*a* as shown in FIG. 7. An annular flange 76*a* extends outwardly from the outer wall 71*a* at the downstream open end 72*a* of the container adapter 70*a*. The flange 76*a* engages the top surface 19*a* of the neck 17*a* of the container 12*a* as shown in FIG. 7. A skirt 77*a* extends longitudinally downward from the outer edge of the flange 76*a*. The skirt 77*a* terminates at its lower end in an inwardly directed circumferential rib 78*a* that engages groove 23*a* of the container 12*a* as described below.

The container adapter 70*a* also includes a sloping inner wall 81*a* that is connected to the outer wall 71*a* and that defines an annular space 82*a* between the inner wall 81*a* and the outer wall 71*a*. Venting holes 83*a* are provided in the inner wall 81 a. The venting holes 83*a* provide an air path between the downstream open end 72*a* of the container adapter 70*a* and the annular space 82*a* between the inner wall 81*a* and the outer wall 71*a*. The container adapter 70*a* also includes an inlet port 85*a* that is connected to the inner wall 81 a. The inlet port 85*a* has an upper tubular section 86*a* that terminates in an upstream open end 87*a* and that terminates at an opposite end at a bottom wall 88*a*. A central hole 89*a* is provided in the bottom wall 88*a* and leads to a lower tubular section 90*a* of the inlet port 85*a*. The lower tubular section 90*a* terminates in a downstream open end 91*a* of the inlet port 85*a* which receives the dip tube 25 in a friction fit. The container adapter 70*a* can be made of a plastic material such as polyethylene or polypropylene.

A cap 95*a* is provided for securing the sprayer base 30 of the sprayer to the neck 17*a* of the container 12*a* as shown in FIG. 7. The cap 95*a* has an annular top wall 96*a* and a cylindrical skirt 97*a* that depends downward from the top wall 96*a*. The inner surface of the skirt 97*a* has threads 98*a* that engage the threads 22*a* on the outer surface 21*a* of the container 12*a* when the sprayer is assembled to the container 12*a*. The inner edge of the annular top wall 96*a* of the cap 95*a* is secured for rotating movement in the annular recess 37 of the outer wall 36 of the sprayer base 30.

Assembly of a sprayer to the container 12*a* proceeds as follows. A sprayer is selected with a sprayer base such as the sprayer base 30 and a cap such as cap 95*a* mounted on the sprayer base 30. The venting valve assembly 41 is constructed as in the embodiment of FIGS. 1-5. The disc-like sprayer gasket 46 is then placed on the lower surface 38 of the sprayer base 30. The exit port 60*a* of the sprayer connector 50*a* is then inserted into the downstream tubular end 32 of the sprayer base 30 as shown in FIG. 7. The sprayer connector 50*a* and the sprayer base 30 may be separate parts as shown in FIGS. 6 to 9 or alternatively, the sprayer connector 50*a* and the sprayer base 30 may be integrally formed as a single piece. In this manner, a sprayer with the sprayer connector 50*a* is provided for connection to the container 12*a*.

The container adapter 70*a* is assembled to the container 12*a*. The dip tube 25 is inserted into the downstream open end 91*a* of the inlet port 85*a* of the container adapter 70*a* in a friction fit. Alternatively, the container adapter 70*a* and the dip tube 25 may be integrally formed as a single piece, or may be secured together such as by adhesive or friction welding. The container adapter 70*a* and the dip tube 25 are then inserted into the opening 20*a* of the container 12*a* so that the outer surface 73*a* of the outer wall 71*a* of the container adapter 70*a* engages the inner surface 18*a* of the neck 17*a* of the container 12*a* and so that the circumferential rib 78*a* of the skirt 77*a* of the container adapter 70*a* enters the groove 23*a* at the top of the container 12*a* as shown in FIG. 7. The annular flange 76*a* engages the top surface 19*a* of the neck 17*a* of the container 12*a* as shown in FIG. 7. In this manner, a container 12*a* with a container adapter 70*a* and attached dip tube 25 is provided for connection to a sprayer with the sprayer connector 50*a*.

In an example automated assembly of the sprayer with the sprayer connector 50*a* to the container 12*a* with the container adapter 70*a* and attached dip tube 25, a plurality of the containers 12*a* with the container adapter 70*a* and attached dip tube 25 travel on a conveyor. A sprayer with the sprayer connector 50*a* is then lowered over each container 12*a* with the container adapter 70*a* and attached dip tube 25. The outer wall 51*a* of the sprayer connector 50*a* is aligned with the upper tubular section 86*a* of the inlet port 85*a* of the container adapter 70*a*. The sprayer connector 50*a* is then lowered into the container adapter 70*a* such that the rib 56*a* on the outer wall 51*a* of the sprayer connector 50*a* seals with the inner surface of the upper tubular section 86*a* of the inlet port 85*a* of the container adapter 70*a*. The cap 95*a* is then automatically threaded on the threads 22*a* on the outer surface 21*a* of the container 12*a* to secure the sprayer to the container 12*a*.

As with container adapter 70, the container adapter 70*a* is dimensioned to provide for easier automated assembly. The sloping inner wall 81*a* of the container adapter 70*a* guides the outer wall 51*a* of the sprayer connector 50*a* into the upper tubular section 86*a* of the inlet port 85*a* of the container adapter 70*a*. Also, the inside diameter of the upper tubular section 86*a* of the inlet port 85*a* of the container adapter 70*a* may decrease from top to bottom to further guide the outer wall 51*a* of the sprayer connector 50*a* into the bottom region of the upper tubular section 86*a* of the inlet port 85*a* of the container adapter 70*a* wherein the rib 56*a* engages the inner surface of the upper tubular section 86*a* of the inlet port 85*a* of the container adapter 70*a*.

Referring to FIG. 7, fluid flow in the device 10*a* is as follows during use of the assembled device. Liquid in the interior space 15*a* of the container 12*a* is suctioned up through dip tube 25. The liquid then enters the lower tubular section 90*a* of the inlet port 85*a*, passes through the central hole 89*a*, and enters the bottom of the upper tubular section 86*a* of the inlet port 85*a*. The liquid then enters the fluid entry port 64*a* of the sprayer connector 50*a* and flows into the lower inner tubular section 63*a* of the sprayer connector 50*a*. Because the rib 56*a* seals against the inner surface of the upper tubular section 86*a* of the inlet port 85*a* of the container adapter 70*a*, liquid is prevented from flowing above the rib 56*a* between the inner surface of the upper tubular section 86*a* of the inlet port 85*a* of the container adapter 70*a* and the outer wall 51*a* of the sprayer connector 50*a*. From the lower inner tubular section 63*a* of the sprayer connector 50*a*, the liquid flows into the upper inner tubular section 59*a* of the sprayer connector 50*a* and exits the fluid exit port 60*a*. The liquid flows into the upstream tubular end 33 of the inlet port 31 of the sprayer base 30 and then into downstream tubular end 32 of the sprayer base 30. The liquid then enters the pumping system (not shown) of the sprayer for spraying out of the nozzle of the sprayer.

As the sprayer is actuated and liquid is removed from the interior space 15*a* of the container 12*a*, negative pressure may result in the container 12*a*. The pressure differential is eliminated by way of the venting valve assembly 41 and the venting holes 83*a* in the container adapter 70*a*. Because of the negative pressure, the duckbill valve 42 opens and air passes downward through the duckbill valve 42 into the vent passageway 43 of the sprayer base 30. The air then travels into the downstream open end 72*a* of the container adapter 70*a* and then into the annular space 82*a* between the inner wall 81*a* and the outer wall 71 a of the container adapter 70*a* by way of the venting holes 83*a*. The air then enters the interior space 15*a* of the container 12*a* equalizing the pressure inside and outside the container 12*a*.

Because the rib 56*a* seals against the inner surface of the upper tubular section 86*a* of the inlet port 85*a* of the container adapter 70*a*, air is prevented from flowing below the rib 56*a* between the inner surface of the upper tubular section 86*a* of the inlet port 85*a* of the container adapter 70*a* and the outer wall 51*a* of the sprayer connector 50*a*. Thus, the rib 56*a* serves to establish and maintain independent liquid and air flow paths when the container adapter 70*a* and the sprayer connector 50*a* are assembled together.

The mating dimensions of the sprayer connector 50*a* and the container adapter 70*a* also provide keying structures that ensure that only refills containing a liquid appropriate for a particular purpose are used with the sprayer. Specifically, a tight fit is required between the sprayer connector 50*a* and the container adapter 70*a* so that the sprayer may be primed with liquid by way of the dip tube 25. If air leakage were to occur between the inner surface of the upper tubular section 86*a* of the inlet port 85*a* of the container adapter 70*a* and the outer wall 51*a* of the sprayer connector 50*a*, the sprayer would suck air into the sprayer rather than liquid. Therefore, only refills comprising a container 12*a* with an attached container adapter 70*a* that mates with the sprayer connector 50*a* of the sprayer would be suitable for use with the container 12*a*.

Figure 10:
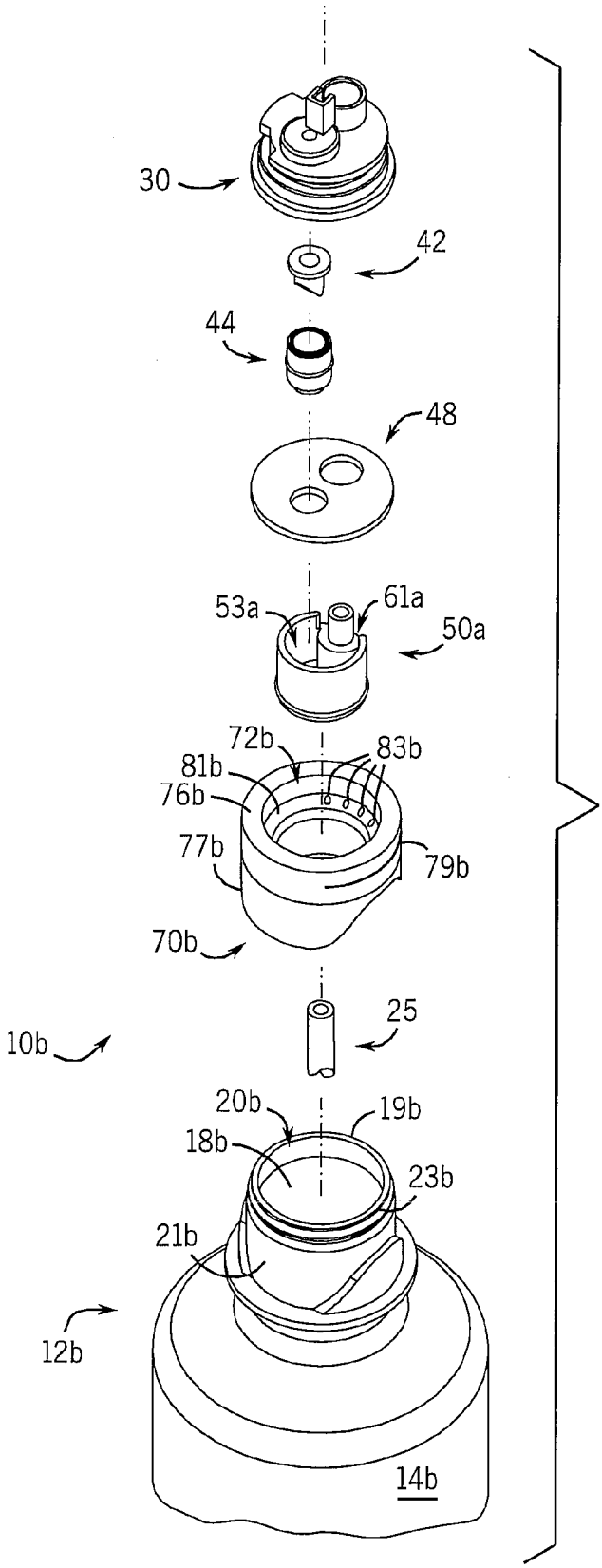
FIG. 10 is an exploded perspective view of a device according to a third embodiment of the invention.
Figure 11:
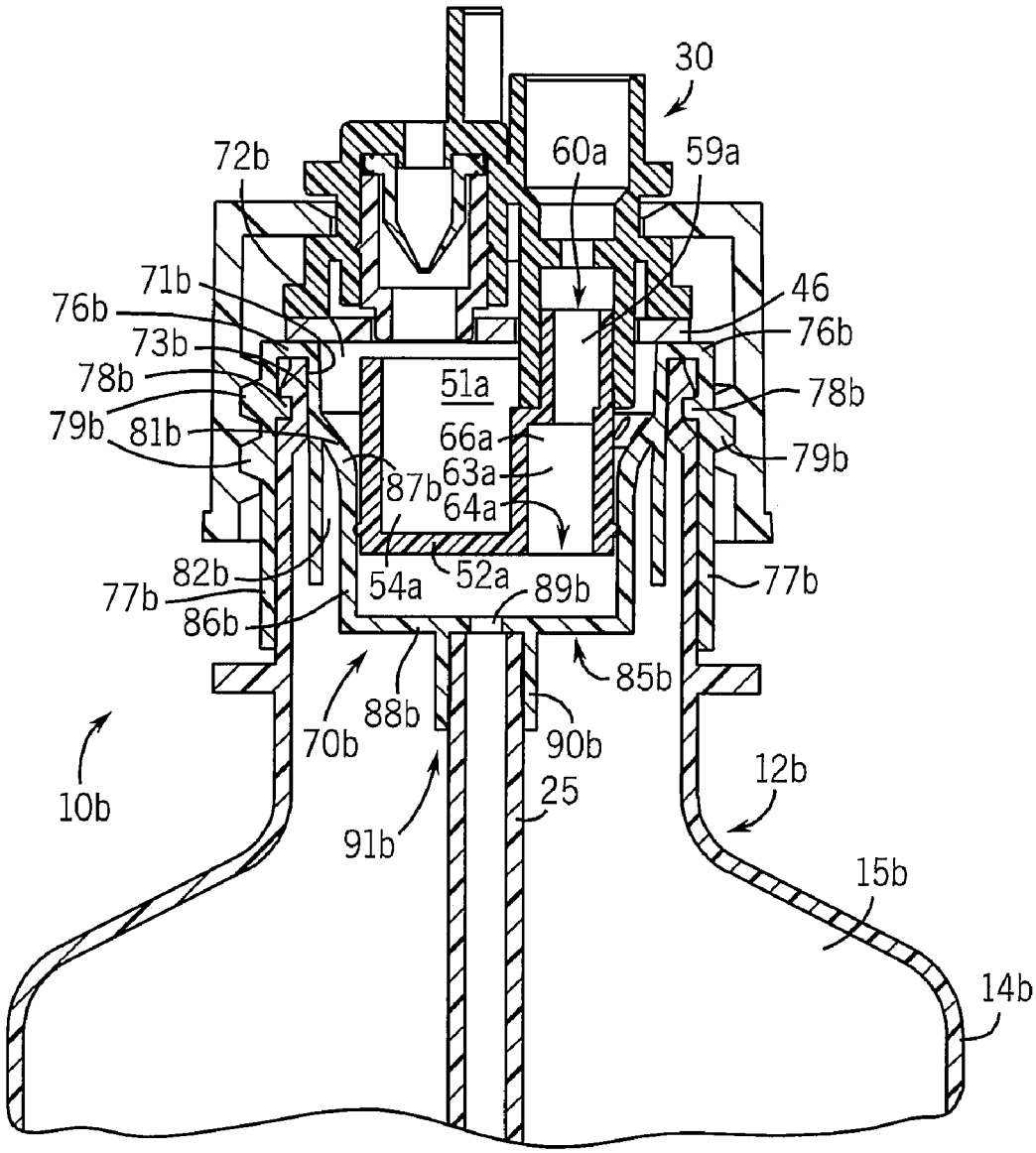
FIG. 11 is a cross-sectional view similar to that of FIG. 3 of the device of FIG. 10.

Turning now to FIGS. 10 and 11, there is shown a third embodiment of a device 10*b* according to the invention. The device 10*b* may be used with a container 12*b* having a bottom wall that is integral with a side wall as in container 12 of FIG. 1. The bottom wall and the side wall 14*b* define an interior space 15*b* of the container 12*b*. The side wall 14*b* of the container 12*b* terminates at its upper end in a neck 17*b* having an inner surface 18*b* and a top surface 1 9*b* that define a container opening 20*b*. The outer surface 21*b* of the neck 17*b* of the container 12*b* also has an annular groove 23*b* for engaging a container adapter 70*b* as described below. A dip tube 25 as in FIGS. 1-5 is provided for suctioning fluid from the interior space 15*b* of the container 12*b*. The container 12*b* may be formed from plastic materials.

The device 10*b* is suitable for use with a sprayer. In FIGS. 10 and 11, there is shown a generally circular sprayer base 30 for a sprayer such as that described above with reference to FIGS. 1-5. Therefore, a description of the sprayer base 30 in FIGS. 10 and 11 is identical to that provided above for FIGS. 1 to 5.

Referring still to FIGS. 10 and 11, the device 10*b* according to the invention includes a sprayer connector 50*a* that connects to the upstream tubular end 33 of the inlet port 31 of the sprayer base 30 as in the embodiment of FIGS. 6 to 9. Therefore, a description of the sprayer connector 50*a* in FIGS. 10-11 is identical to that provided above for FIGS. 6-9.

Still looking at FIGS. 10 and 11, the device 10*b* according to the invention includes a container adapter 70*b* that connects to the neck 17*b* of the container 12*b*. The container adapter 70*b* has a cylindrical outer wall 71*b* that terminates in a downstream open end 72*b*. The outer wall 71*b* of the container adapter 70 has an outer surface 73*b* that engages the inner surface 18*b* of the neck 17*b* of the container 12*b* as shown in FIG. 7. An annular flange 76*b* extends outwardly from the outer wall 71*b* at the downstream open end 72*b* of the container adapter 70*b*. The flange 76*b* engages the neck 17*b* of the container 12*b* as shown in FIG. 7. A skirt 77*b* extends longitudinally downward from the outer edge of the flange 76*b*. The skirt 77*b* has at its upper inner end in an inwardly directed circumferential rib 78*b* that engages groove 23*b* of the container 12*b*. The outer surface of the skirt 77*b* has threads 79*b* for engaging a sprayer cap as described below.

The container adapter 70*b* also includes a sloping inner wall 81*b* that is connected to the outer wall 71*b* and that defines an annular space 82*b* between the inner wall 81*b* and the outer wall 71*b*. Venting holes 83*b* are provided in the inner wall 81*b*. The venting holes 83*b* provide an air path between the downstream open end 72*b* of the container adapter 70*b* and the annular space 82*b* between the inner wall 81*b* and the outer wall 71*b*. The container adapter 70*b* also includes an inlet port 85*b* that is connected to the inner wall 81*b*. The inlet port 85*b* has an upper tubular section 86*b* that terminates in an upstream open end 87*b* and that terminates at an opposite end at a bottom wall 88*b*. A central hole 89*b* is provided in the bottom wall 88*b* and leads to a lower tubular section 90*b* of the inlet port 85*b*. The lower tubular section 90*b* terminates in a downstream open end 91*b* of the inlet port 85*b* which receives the dip tube 25 in a friction fit. The container adapter 70*b* can be made of a plastic material such as polyethylene or polypropylene.

A cap 95*b* is provided for securing the sprayer base 30 of the sprayer to the container adapter 70*b* as shown in FIG. 11. The cap 95*b* has an annular top wall 96*b* and a cylindrical skirt 97*b* that depends downward from the top wall 96*b*. The inner surface of the skirt 97*b* has threads 98*b* that engage the threads 79*b* on the outer surface of the skirt 77*b* of the container adapter 70*b* when the sprayer is assembled to the container 12*b*. The inner edge of the annular top wall 96*b* of the cap 95*b* is secured for rotating movement in the annular recess 37 of the outer wall 36 of the sprayer base 30.

Assembly of a sprayer to the container 12*b* proceeds as follows. A sprayer is selected with a sprayer base such as the sprayer base 30 and a cap such as cap 95*b* mounted on the sprayer base 30. The venting valve assembly 41 is constructed as in the embodiment of FIGS. 1-5. The disc-like sprayer gasket 46 is then placed on the lower surface 38 of the sprayer base 30. The exit port 60*a* of the sprayer connector 50*a* is then inserted into the downstream tubular end 32 of the sprayer base 30 as shown in FIG. 11. The sprayer connector 50*a* and the sprayer base 30 may be separate parts as shown in FIGS. 10 and 11 or alternatively, the sprayer connector 50*a* and the sprayer base 30 may be integrally formed as a single piece. In this manner, a sprayer with the sprayer connector 50*a* is provided for connection to the container 12*b*.

The container adapter 70*b* is assembled to the container 12*b*. The dip tube 25 is inserted into the downstream open end 91*b* of the inlet port 85*b* of the container adapter 70*b* in a friction fit. Alternatively, the container adapter 70*b* and the dip tube 25 may be integrally formed as a single piece, or may be secured together such as by adhesive or friction welding. The container adapter 70*b* and the dip tube 25 are then inserted into the opening 20*b* of the container 12*b* so that the outer surface 73*b* of the outer wall 71*b* of the container adapter 70*b* engages the inner surface 18*b* of the neck 17*b* of the container 12*b* and so that the circumferential rib 78*b* of the skirt 77*b* of the container adapter 70*b* enters the groove 23*b* at the top of the container 12*b* as shown in FIG. 11. The annular flange 76*b* engages the top surface 19*b* of the neck 17*b* of the container 12*b* as shown in FIG. 11. The annular flange 76*b* could also be attached to the neck 17*b* of the container 12*b* by alternative means such as welding or adhesives. In this manner, a container 12*b* with a container adapter 70*b* and attached dip tube 25 is provided for connection to a sprayer with the sprayer connector 50*a*.

In an example automated assembly of the sprayer with the sprayer connector 50*a* to the container 12*b* with the container adapter 70*b* and attached dip tube 25, a plurality of the containers 12*b* with the container adapter 70*b* and attached dip tube 25 travel on a conveyor. A sprayer with the sprayer connector 50*a* is then lowered over each container 12*b* with the container adapter 70*b* and attached dip tube 25. The outer wall 51*a* of the sprayer connector 50*a* is aligned with the upper tubular section 86*b* of the inlet port 85*b* of the container adapter 70*b*. The sprayer connector 50*a* is then lowered into the container adapter 70*b* such that the rib 56*a* on the outer wall 51*a* of the sprayer connector 50*a* seals with the inner surface of the upper tubular section 86*b* of the inlet port 85*b* of the container adapter 70*b*. The cap 95*b* is then automatically threaded on the threads 79*b* on the outer surface of the skirt 77*b* of the container adapter 70*b* to secure the sprayer to the container 12*b*.

The container adapter 70*b* is dimensioned to provide for easier automated assembly. For example, the sloping inner wall 81*b* of the container adapter 70*b* guides the outer wall 51*a* of the sprayer connector 50*a* into the upper tubular section 86*b* of the inlet port 85*b* of the container adapter 70*b*. Also, the inside diameter of the upper tubular section 86*b* of the inlet port 85*b* of the container adapter 70*b* may decrease from top to bottom to further guide the outer wall 51*a* of the sprayer connector 50*a* into the bottom region of the upper tubular section 86*b* of the inlet port 85*b* of the container adapter 70*b* wherein the rib 56*a* engages the inner surface of the upper tubular section 86*b* of the inlet port 85*b* of the container adapter 70*b*.

Referring to FIG. 11, fluid flow in the device 10*b* is as follows. Liquid in the interior space 15*b* of the container 12*b* is suctioned up through dip tube 25. The liquid then enters the lower tubular section 90*b* of the inlet port 85*b*, passes through the central hole 89*b*, and enters the bottom of the upper tubular section 86*b* of the inlet port 85*b*. The liquid then enters the fluid entry port 64*a* of the sprayer connector 50*a* and flows into the lower inner tubular section 63*a* of the sprayer connector 50*a*. Because the rib 56*a* seals against the inner surface of the upper tubular section 86*b* of the inlet port 85*b* of the container adapter 70*b*, liquid is prevented from flowing above the rib 56*a* between the inner surface of the upper tubular section 86*b* of the inlet port 85*b* of the container adapter 70*b* and the outer wall 51*a* of the sprayer connector 50*a*. From the lower inner tubular section 63*a* of the sprayer connector 50*a*, the liquid flows into the upper inner tubular section 59*a* of the sprayer connector 50*a* and exits the fluid exit port 60*a*. The liquid flows into the upstream tubular end 33 of the inlet port 31 of the sprayer base 30 and then into downstream tubular end 32 of the sprayer base 30. The liquid then enters the pumping system of the sprayer (not shown) for spraying out of the nozzle of the sprayer.

As the sprayer is actuated and liquid is removed from the interior space 15*b* of the container 12*b*, negative pressure may result in the container 12*b*. The pressure differential is eliminated by way of the venting valve assembly 41 and the venting holes 83*b* in the container adapter 70*b*. Because of the negative pressure, the duckbill valve 42 opens and air passes downward through the duckbill valve 42 into the vent passageway 43 of the sprayer base 30. The air then travels into the downstream open end 72*b* of the container adapter 70*b* and then into the annular space 82*b* between the inner wall 81*b* and the outer wall 71*b* of the container adapter 70*b* by way of the venting holes 83*b*. The air then enters the interior space 15*b* of the container 12*b* equalizing the pressure inside and outside the container 12*b*.

Because the rib 56*a* seals against the inner surface of the upper tubular section 86*b* of the inlet port 85*b* of the container adapter 70*b*, air is prevented from flowing below the rib 56*a* between the inner surface of the upper tubular section 86*b* of the inlet port 85*b* of the container adapter 70*b* and the outer wall 51*a* of the sprayer connector 50*a*. Thus, the rib 56*a* serves to establish and maintain independent liquid and air flow paths when the container adapter 70*b* and the sprayer connector 50*a* are assembled together.

The mating dimensions of the sprayer connector 50*a* and the container adapter 70*b* also provide keying structures that ensure that only refills containing a liquid appropriate for a particular purpose are used with the sprayer. Specifically, a tight fit is required between the sprayer connector 50*a* and the container adapter 70*b* so that the sprayer may be primed with liquid by way of the dip tube 25. If air leakage were to occur between the inner surface of the upper tubular section 86*b* of the inlet port 85*b* of the container adapter 70*b* and the outer wall 51*a* of the sprayer connector 50*a*, the sprayer would suck air into the sprayer rather than liquid. Therefore, only refills comprising a container 12*b* with an attached container adapter 70*b* that mates with the sprayer connector 50*a* of the sprayer would be suitable for use with the container.

Figure 12:
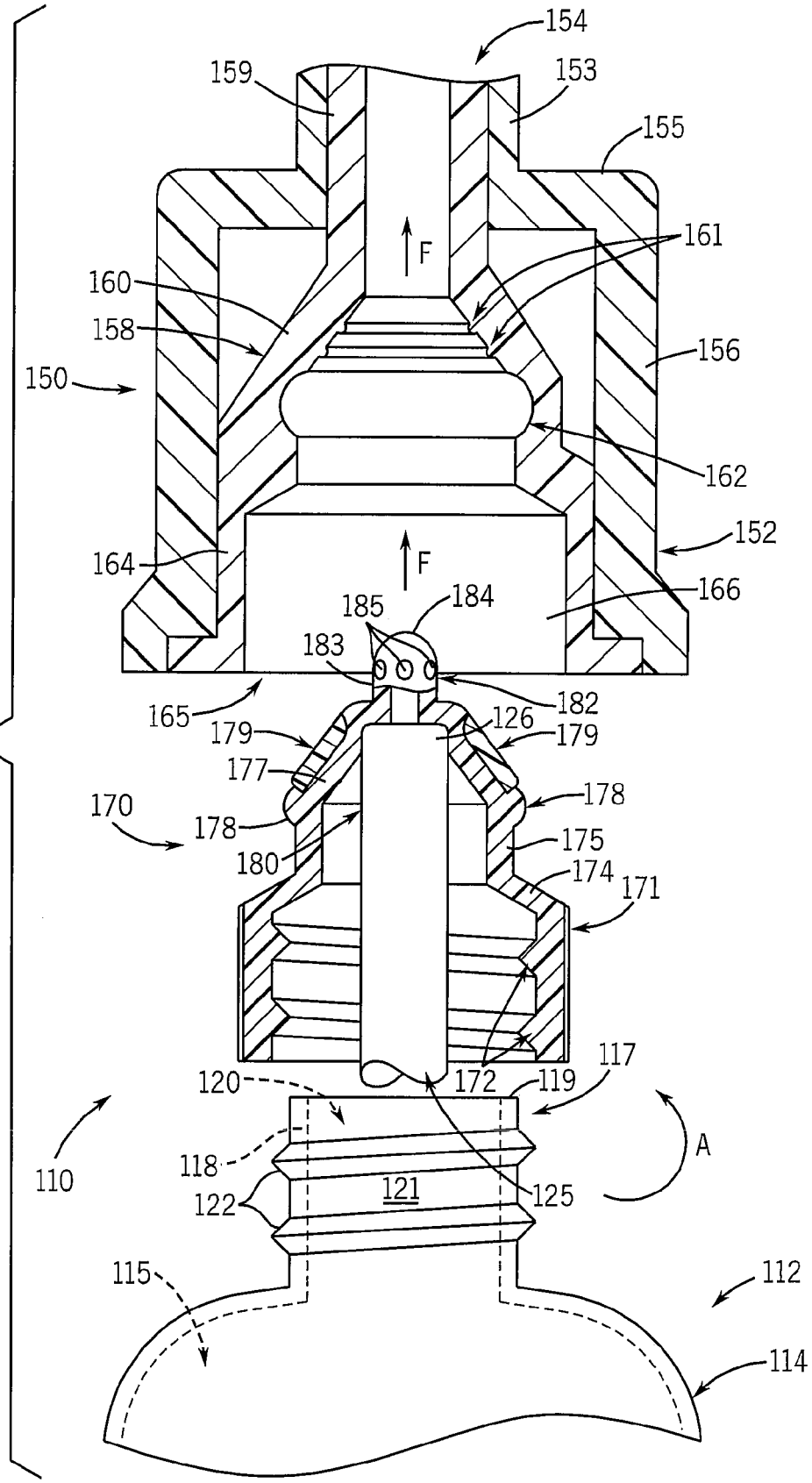
FIG. 12 is an exploded cross-sectional view of a device according to a fourth embodiment of the invention.

Turning now to FIG. 12, there is shown a fourth embodiment of a device 110 according to the invention. The device 110 is suitable for use with a sprayer with a sprayer base having an inlet port similar to that described above with reference to FIGS. 1 to 5. The device 110 may be used with a container 112 having a bottom wall that is integral with a side wall as in container 12 of FIG. 1. The bottom wall and the side wall 114 define an interior space 115 of the container 112. The side wall 114 of the container 112 terminates at its upper end in a circular neck 117 having a wall 118 and a top surface 119 that define a container opening 120. The outer surface 121 of the neck 117 of the container 112 has threads 122 for engaging a container adapter 170 as described below. A dip tube 125 is provided for suctioning fluid from the interior space 115 of the container 112. The container 112 and dip tube 125 may be formed from plastic materials.

Referring still to FIG. 12, the device 110 according to the invention includes a sprayer connector 150 that connects to the inlet port of the sprayer base. The sprayer connector 150 has a circular outer wall 152 with a downstream tubular section 153 that defines an outer wall of an exit port 154, a shoulder 156 and an upstream tubular section 156. The sprayer connector 150 also has a circular inner wall 158 including a downstream tubular section 159 that forms an inner wall of the exit port 154, a central sloping wall 160 having inner surface sealing ribs 161 and an inner surface annular recess 162, and an upstream tubular section 164 that forms an inner wall of an entry port 165. The hollow inner wall 158 defines a flow conduit 166 in the sprayer connector 150. The sprayer connector 150 may be formed from a plastic material such as ABS or like material.

Still looking at FIG. 12, the device 110 according to the invention includes a container adapter 170 that connects to the neck 117 of the container 112. The container adapter 170 includes a circular upstream tubular section 171 having inner surface threads 172, a circular upstream sloping wall 174, a circular central tubular section 175, a circular downstream sloping wall 177 having an outer sealing protrusion 178 and an outer sealing strip 179 and an inner recess 180 dimensioned to receive the dip tube 125 in a friction fit, and a fluid exit port 182. The fluid exit port 182 is a hollow circular projection 183 having a domed outer surface 184 and having circumferentially arranged flow holes 185. The container adapter 170 can be made of a plastic material such as polyethylene or polypropylene. Preferably, the outer sealing strip 179 is a softer material than the remainder of the container adapter 170. The outer sealing strip 179 may be produced in an overmolding or two shot forming process.

Assembly of a sprayer to the container 112 proceeds as follows. A sprayer is selected with a sprayer base having a tubular inlet port. The exit port 154 of the sprayer connector 150 is then inserted into the inlet port of the sprayer base. The sprayer connector 150 and the sprayer base may be separate parts or alternatively, the sprayer connector 150 and the sprayer base may be integrally formed as a single piece. In this manner, a sprayer with the sprayer connector 150 is provided for connection to the container 112.

The container adapter 170 is assembled to the container 112. The dip tube 125 is inserted into the recess 180 of the container adapter 170 in a friction fit as shown in FIG. 12. Alternatively, the container adapter 170 and the dip tube 125 may be integrally formed as a single piece, or may be secured together such as by adhesive or friction welding. The dip tube 125 are then inserted into the opening 120 of the container 112. The container adapter 170 is then lowered onto the neck 117 of the container 112 such that the inner surface threads 172 of the container adapter 170 engage the threads 122 on the outer surface 121 of the neck 117 of the container 112. Rotation of the container adapter 170 in direction A of FIG. 12 will attach the container adapter 170 to the neck 117 of the container 112. In this manner, a container 112 with a container adapter 170 and attached dip tube 125 is provided for connection to a sprayer with the sprayer connector 150.

In an example automated assembly of the sprayer with the sprayer connector 150 to the container 112 with the container adapter 170 and attached dip tube 125, a plurality of the containers 112 with the container adapter 170 and attached dip tube 125 travel on a conveyor. A sprayer with the sprayer connector 150 is then lowered over each container 112 with the container adapter 170 and attached dip tube 125. The inner wall 158 of the sprayer connector 150 is aligned with the outer surface of the container adapter 170. The sprayer connector 150 is then lowered over the container adapter 170 such that the sealing protrusion 178 on the inner surface of container adapter 170 enters the recess 162 of the sprayer connector 150. Also, the inner surface sealing ribs 161 of the sprayer connector 150 engage the outer sealing strip 179 of the container adapter 170 to provide an air-tight fit. The container adapter 170 is dimensioned to provide for easier automated assembly. For example, the sloping wall 177 of the container adapter 170 guides the sprayer connector 150 over the outer surface of the container adapter 170.

Referring still to FIG. 12, fluid flow F in the device 110 is as follows during use of the assembled device. When the sprayer is actuated (for example, by repeatedly pulling a manual trigger that operates a pump or by pulling a trigger switch that activates an electric pump), liquid in the interior space 115 of the container 112 is suctioned up through dip tube 125. The liquid then enters the hollow circular projection 183 of the fluid exit port 182 of the container adapter 170 and the liquid then exits the flow holes 185 of the fluid exit port 182. The liquid continues through the flow conduit 166 of the sprayer connector 150 and then enters the sprayer.

The mating dimensions of the sprayer connector 150 and the container adapter 170 also provide keying structures that ensure that only refills containing a liquid appropriate for a particular purpose are used with the sprayer. Specifically, a tight fit is required between the sprayer connector 150 and the container adapter 170 so that the sprayer may be primed with liquid by way of the dip tube 125. If air leakage were to occur, the sprayer would suck air into the sprayer rather than liquid. Therefore, only refills comprising a container 112 with an attached container adapter 170 that mates with the sprayer connector 150 of the sprayer would be suitable for use with the container 112.

Thus, the present invention provides a device that that places an interior space of a fluid container in fluid communication with a sprayer and that provides a keying structure such that only refill containers having a liquid appropriate for a particular purpose are used with the sprayer.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a container adapter that allows a dip tube to be attached to a fluid container rather than the fluid sprayer and that provides a keying structure such that only refill containers having a liquid appropriate for a particular purpose are used with the sprayer.

What is claimed is:

1. A device for placing an inlet port of a sprayer in fluid communication with an interior space of a container including a neck having an opening, the device comprising:

a container adapter comprising (i) an outer wall that terminates at an open end of the adapter, the outer wall being dimensioned to engage the neck of the container, the outer wall having an upper portion and a lower portion extending downward from the upper portion, (ii) an inlet port that terminates at an upstream open end and that terminates at a downstream open end, and (iii) an inner wall connected to the upper portion of the outer wall by a sloping upper portion of the inner wall and connected to the upstream open end of the inlet port, at least a part of the inner wall defining a space and vent path between the outer wall and the upstream open end of the inlet port; and a sprayer connector in communication with a venting duckbill valve and having a flow conduit suitable for being placed in fluid communication with the inlet port of the sprayer and the adapter, the sprayer connector being dimensioned to matingly engage the inner wall of the adapter;

wherein the sloping upper portion comprises a venting hole to vent via a path extending from the duckbill valve to a passage outside of the sprayer connector, whereby the sprayer and adapter are suitable to vent air to the container without the need for venting air passing through the sprayer connector; and wherein the adapter further comprises one or more keying structures to provide a tight fit with the sprayer connector, and to ensure that only refill containers containing a liquid appropriate for a particular purpose are used with the sprayer.

2. The device of claim 1 wherein:

the device further comprises a dip tube, and the downstream open end of the inlet port of the adapter is dimensioned to sealingly engage the dip tube.

3. The device of claim 1 wherein:

an outer surface of the sprayer connector includes at least one sealing rib for engaging the inner wall of the adapter, or an inner surface of the adapter includes at least one sealing rib for engaging the outer surface of the sprayer connector.

4. The device of claim 1 wherein:

the open end of the adapter comprises an outwardly projecting lateral flange dimensioned to sealingly engage an end surface of the neck of the container;

the adapter further includes a skirt that extends longitudinally from the lateral flange, an inner surface of the skirt including a sealing protrusion for engaging an outer surface of the neck of the container.

5. The device of claim 4 wherein:

an outer surface of the skirt includes threads for engaging inner threads on an attachment cap of the sprayer.

6. The device of claim 1 wherein:

together the inner wall and the inlet port of the adapter are funnel shaped.

7. The device of claim 1 wherein:

the sprayer connector includes an outwardly extending exit port in fluid communication with the flow conduit, the exit port being dimensioned to sealingly engage the inlet port of the sprayer.

8. A fluid container for attaching to a sprayer having an inlet port, the container comprising:

a bottom wall;

side wall structure;

a neck having an opening, the bottom wall, the side wall structure, and the neck defining an interior space of the container; and a container adapter comprising (i) an outer wall that terminates at an open end of the adapter, the outer wall being dimensioned to engage the neck of the container, the outer wall having an upper portion and a lower portion extending downward from the upper portion, (ii) an inlet port that terminates at an upstream open end and that terminates at a downstream open end, and (iii) an inner wall connected to the upper portion of the outer wall by a sloping upper portion of the inner wall and connected to the upstream open end of the inlet port, at least a part of the inner wall defining a space and vent path between the outer wall and the upstream open end of the inlet port;

(iv) a tubular section connected to a bottom wall of the inlet port, wherein the tubular section receives a dip tube, the dip tube terminating before reaching the upstream open end of the inlet port;

(v) wherein the container adapter further comprises one or more keying structures to provide a tight fit with a sprayer connector, and to ensure that only refill containers containing a liquid appropriate for a particular purpose are used with the sprayer;

(vi) the sprayer connector being in communication with a venting duckbill valve and having a flow conduit suitable for being placed in fluid communication with the inlet port of the sprayer and the adapter, the sprayer connector being dimensioned to matingly engage the inner wall of the adapter; and (vii) the sloping upper portion comprises a venting hole to vent via a path extending from the duckbill valve to a passage outside of the sprayer connector, whereby the sprayer and adapter are suitable to vent air to the container without the need for venting air passing through the sprayer connector;

a sprayer connector in communication with a venting duckbill valve and having a flow conduit suitable for being placed in fluid communication with the inlet port of the sprayer and the adapter, the sprayer connector being dimensioned to matingly engage the inner wall of the adapter; and wherein the sloping upper portion comprises a venting hole to vent via a path extending from the duckbill valve to a passage outside of the sprayer connector, whereby the sprayer and adapter are suitable to vent air to the container without the need for venting air passing through the, sprayer connector.

9. The container of claim 8 wherein:

the sloping upper portion of the inner wall of the adapter comprises a plurality of such venting holes.

10. The container of claim 8 wherein:

the open end of the adapter includes an outwardly projecting lateral flange that sealingly engages an end surface of the neck of the container.

11. The container of claim 10 wherein:

the adapter further includes a skirt that extends longitudinally from the lateral flange, an inner surface of the skirt including a sealing protrusion that sealingly engages an outer surface of the neck of the container.

12. The container of claim 11 wherein:

an outer surface of the skirt includes threads for engaging inner threads on an attachment cap of the sprayer.

* * * * *

UNITED STATES PATENT AND TRADEMARK OFFICE

CERTIFICATE OF CORRECTION

PATENT NO. : 7,938,299 B2
APPLICATION NO. : 11/556274
DATED : May 10, 2011
INVENTOR(S) : Cathal L. Fahy et al.

It is certified that error appears in the above-identified patent and that said Letters Patent is hereby corrected as shown below:

Column 18, Line 31: replace “the, sprayer” with --the sprayer--

Signed and Sealed this
Sixth Day of September, 2011

David J. Kappos

David J. Kappos
*Director of the United States Patent and Trademark Office*